US008100739B2

(12) United States Patent
Yasuda et al.

(10) Patent No.: US 8,100,739 B2
(45) Date of Patent: Jan. 24, 2012

(54) SUBSTRATE HOLDING APPARATUS, POLISHING APPARATUS, AND POLISHING METHOD

(75) Inventors: Hozumi Yasuda, Tokyo (JP); Tetsuji Togawa, Tokyo (JP); Osamu Nabeya, Tokyo (JP); Kenichiro Saito, Tokyo (JP); Makoto Fukushima, Tokyo (JP); Tomoshi Inoue, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 12/222,908

(22) Filed: Aug. 19, 2008

(65) Prior Publication Data

US 2008/0318492 A1 Dec. 25, 2008

Related U.S. Application Data

(62) Division of application No. 11/730,142, filed on Mar. 29, 2007, now Pat. No. 7,967,665.

(30) Foreign Application Priority Data

Mar. 31, 2006 (JP) ..... 2006-097296

(51) Int. Cl.
*B24B 49/00* (2006.01)

(52) U.S. Cl. ..... 451/5; 451/9; 451/10; 451/11; 451/285; 451/288; 451/398

(58) Field of Classification Search ..... 451/5, 6, 451/7, 287, 288, 397, 526, 364, 384–387, 451/405, 8, 9, 10, 11, 41, 285, 286, 290, 451/398

See application file for complete search history.

(56) References Cited

U.S. PATENT DOCUMENTS

| | | | | |
|---|---|---|---|---|
| 3,453,783 | A | 7/1969 | Queen | |
| 5,803,799 | A * | 9/1998 | Volodarsky et al. | 451/288 |
| 5,876,265 | A | 3/1999 | Kojima | |
| 6,012,964 | A * | 1/2000 | Arai et al. | 451/5 |
| 6,027,398 | A * | 2/2000 | Numoto et al. | 451/285 |
| 6,036,587 | A | 3/2000 | Tolles et al. | |
| 6,059,638 | A | 5/2000 | Crevasse et al. | |
| 6,084,574 | A * | 7/2000 | Bidiville | 345/166 |
| 6,110,025 | A | 8/2000 | Williams et al. | |

(Continued)

FOREIGN PATENT DOCUMENTS

EP 1 197 292 4/2002

(Continued)

OTHER PUBLICATIONS

Extended European Search Report issued Aug. 4, 2009 in European Application No. EP 08 01 7248, which is a foreign counterpart of the present invention.

(Continued)

*Primary Examiner* — Eileen P. Morgan
(74) *Attorney, Agent, or Firm* — Wenderoth, Lind & Ponack, L.L.P.

(57) ABSTRACT

A substrate holding apparatus prevents a substrate from slipping out and allows the substrate to be polished stably. The substrate holding apparatus has a top ring body for holding and pressing a substrate against a polishing surface, and a retainer ring for pressing the polishing surface, the retainer ring being disposed on an outer circumferential portion of the top ring body. The retainer ring includes a first member made of a magnetic material and a second member having a magnet disposed on a surface thereof which is held in abutment against the first member.

3 Claims, 6 Drawing Sheets

U.S. PATENT DOCUMENTS

| | | | | |
|---|---|---|---|---|
| 6,186,865 | B1 * | 2/2001 | Thornton et al. | 451/8 |
| 6,210,255 | B1 * | 4/2001 | Zuniga et al. | 451/41 |
| 6,220,930 | B1 * | 4/2001 | Lin et al. | 451/8 |
| 6,231,428 | B1 * | 5/2001 | Maloney et al. | 451/41 |
| 6,242,353 | B1 * | 6/2001 | Kobayashi et al. | 438/692 |
| 6,282,053 | B1 * | 8/2001 | MacLeod et al. | 360/98.07 |
| 6,293,846 | B1 * | 9/2001 | Oguri | 451/6 |
| 6,354,928 | B1 * | 3/2002 | Crevasse et al. | 451/397 |
| 6,368,189 | B1 * | 4/2002 | Maloney et al. | 451/41 |
| 6,386,947 | B2 | 5/2002 | Donohue | |
| 6,390,908 | B1 * | 5/2002 | Chen et al. | 451/398 |
| 6,398,906 | B1 * | 6/2002 | Kobayashi et al. | 156/345.12 |
| 6,435,948 | B1 * | 8/2002 | Molnar | 451/41 |
| 6,443,815 | B1 * | 9/2002 | Williams | 451/56 |
| 6,443,823 | B1 * | 9/2002 | Tolles et al. | 451/288 |
| 6,506,105 | B1 * | 1/2003 | Kajiwara et al. | 451/289 |
| 6,609,950 | B2 * | 8/2003 | Kimura et al. | 451/5 |
| 6,634,924 | B1 | 10/2003 | Ono et al. | |
| 6,652,357 | B1 * | 11/2003 | Williams | 451/8 |
| 6,695,681 | B2 * | 2/2004 | Wolf | 451/6 |
| 6,857,945 | B1 * | 2/2005 | Chen et al. | 451/288 |
| 6,893,327 | B2 * | 5/2005 | Kajiwara et al. | 451/41 |
| 6,976,903 | B1 * | 12/2005 | Williams | 451/8 |
| 6,986,698 | B1 * | 1/2006 | Molnar | 451/5 |
| 7,008,300 | B1 * | 3/2006 | Molnar | 451/41 |
| 7,029,382 | B2 * | 4/2006 | Maloney et al. | 451/288 |
| 7,066,785 | B2 * | 6/2006 | Park et al. | 451/5 |
| 7,134,948 | B2 | 11/2006 | Tseng et al. | |
| 7,198,561 | B2 * | 4/2007 | Chen et al. | 451/288 |
| 7,291,057 | B2 * | 11/2007 | Kimura et al. | 451/8 |
| 7,377,836 | B1 * | 5/2008 | Molnar | 451/5 |
| 2001/0000770 | A1 * | 5/2001 | Lin et al. | 451/8 |
| 2002/0028629 | A1 * | 3/2002 | Moore | 451/6 |
| 2002/0042246 | A1 | 4/2002 | Togawa et al. | |
| 2002/0086624 | A1 * | 7/2002 | Zuniga et al. | 451/56 |
| 2002/0146970 | A1 * | 10/2002 | Saldana et al. | 451/285 |
| 2002/0188370 | A1 * | 12/2002 | Saldana et al. | 700/121 |
| 2003/0148718 | A1 * | 8/2003 | Yun et al. | 451/288 |
| 2003/0232576 | A1 * | 12/2003 | Kimura et al. | 451/11 |
| 2004/0032256 | A1 * | 2/2004 | Tada et al. | 324/230 |
| 2005/0095964 | A1 | 5/2005 | Hengel, Jr. | |
| 2005/0112998 | A1 * | 5/2005 | Matsuo et al. | 451/5 |
| 2006/0160474 | A1 | 7/2006 | Tseng et al. | |
| 2007/0232193 | A1 * | 10/2007 | Yasuda et al. | 451/5 |
| 2007/0243796 | A1 * | 10/2007 | Torii | 451/5 |

FOREIGN PATENT DOCUMENTS

| | | | |
|---|---|---|---|
| JP | 11-000860 | | 1/1999 |
| JP | 11000860 | A * | 1/1999 |
| JP | 11-254311 | | 9/1999 |
| JP | 2000-117626 | | 4/2000 |
| JP | 2001009712 | A * | 1/2001 |
| JP | 2001009715 | A * | 1/2001 |
| WO | WO 2004041479 | A1 * | 5/2004 |
| WO | 2006/049269 | | 5/2006 |

OTHER PUBLICATIONS

European Search Report issued Dec. 3, 2007 in the International (PCT) Application of which the present application is a divisional of the U.S. National Stage.

* cited by examiner

SUBSTRATE HOLDING APPARATUS, POLISHING APPARATUS, AND POLISHING METHOD

This is a divisional application of U.S. patent application Ser. No. 11/730,142, filed Mar. 29, 2007 now U.S. Pat. No. 7,967,665.

BACKGROUND OF THE INVENTION

1. Field of the Invention

The present invention relates to a substrate holding apparatus for holding a substrate as a workpiece to be polished and pressing the substrate against a polishing surface, and more particularly to a substrate holding apparatus for holding a substrate, such as a semiconductor wafer or the like, in a polishing apparatus which planarizes a substrate by polishing the substrate. The present invention also relates to a polishing apparatus having such a substrate holding apparatus, and a polishing method which is carried out by such a polishing apparatus.

2. Description of the Related Art

In recent years, semiconductor devices have become more integrated, and structures of semiconductor elements have become more complicated. Further, the number of levels in multi-level interconnects used for a logical system has been increased. Accordingly, irregularities on a surface of a semiconductor device become increased, so that step heights on the surface of the semiconductor device tend to be larger. This is because, in a process of manufacturing a semiconductor device, a thin film is formed on a semiconductor substrate, then micromachining processes, such as patterning or forming holes, are performed on the semiconductor substrate, and these processes are repeated many times to form subsequent thin films on the semiconductor substrate.

When irregularities of a surface of a semiconductor device are increased, the following problems arise: A thickness of a film formed in a portion having a step is relatively small when a thin film is formed on a semiconductor device. An open circuit is caused by the disconnection of interconnects, or a short circuit is caused by insufficient insulation between interconnect layers. As a result, good products cannot be obtained, and yield tends to be reduced. Further, even if a semiconductor device initially works normally, reliability of the semiconductor device is lowered after long-term use. At a time of exposure during a lithography process, if an irradiation surface has irregularities, then a lens unit in an exposure system is locally unfocused. Therefore, if the irregularities on the surface of the semiconductor device are increased, then this becomes problematic in that it is difficult to form a fine pattern itself on the semiconductor device.

Accordingly, in a process of manufacturing a semiconductor device, it increasingly becomes important to planarize a surface of a semiconductor substrate. The most important one of the planarizing technologies is CMP (Chemical Mechanical Polishing). In a chemical mechanical polishing process, which is performed by a polishing apparatus, while a polishing liquid containing abrasive particles, such as silica ($SiO_2$), is supplied onto a polishing surface, such as a polishing pad, a substrate, such as a semiconductor wafer, is brought into sliding contact with the polishing surface, thereby polishing the substrate.

This type of polishing apparatus comprises a polishing table having a polishing surface constituted by a polishing pad, and a substrate holding apparatus, which is called as a top ring or a carrier head, for holding a semiconductor wafer. When a semiconductor wafer is polished with such a polishing apparatus, the semiconductor wafer is held and pressed against the polishing table under a predetermined pressure by the substrate holding apparatus. At this time, the polishing table and the substrate holding apparatus are moved relatively to each other to bring the semiconductor wafer into sliding contact with the polishing surface, so that a surface of the semiconductor wafer is polished to a flat mirror finish.

In such a polishing apparatus, if a relative pressing force between the semiconductor wafer being polished and the polishing surface of the polishing pad is not uniform over an entire surface of the semiconductor wafer, then the semiconductor wafer may insufficiently be polished or may excessively be polished at some portions depending on a pressing force applied to those portions of the semiconductor wafer. Therefore, it has been attempted to form a surface, for holding a semiconductor wafer, of a substrate holding apparatus as an elastic membrane made of an elastic material, such as rubber, and to supply fluid pressure, such as air pressure, to a backside surface of the elastic membrane to uniformize pressing forces applied to the semiconductor wafer over an entire surface of the semiconductor wafer.

Further, the polishing pad is so elastic that pressing forces applied to a peripheral portion of the semiconductor wafer being polished become non-uniform, and hence only the peripheral portion of the semiconductor wafer may excessively be polished, which is referred to as "edge rounding". In order to prevent such edge rounding, used a substrate holding apparatus has been used in which a semiconductor wafer is held at its peripheral portion by a guide ring or a retainer ring, and an annular portion of the polishing surface that corresponds to the peripheral portion of the semiconductor wafer is pressed by the guide ring or the retainer ring.

However, the use of the retainer ring is problematic in that the semiconductor wafer held in place by the retainer ring tends to be accidentally dislodged from the substrate holding apparatus during the polishing process, and cannot stably be polished.

SUMMARY OF THE INVENTION

The present invention has been made in view of the above situation in the related art. It is therefore an object of the present invention to provide a substrate holding apparatus, a polishing apparatus, and a polishing method which are effective to prevent a substrate as a workpiece to be polished from slipping out and to allow the substrate to be polished stably.

According to a first aspect of the present invention, a substrate holding apparatus is provided which prevents a substrate as a workpiece to be polished from slipping out and allows the substrate to be polished stably. The substrate holding apparatus comprises a top ring body for holding and pressing a substrate against a polishing surface, and a retainer ring for pressing the polishing surface, the retainer ring being disposed on an outer circumferential portion of the top ring body. The retainer ring comprises a first member made of a magnetic material and a second member having a magnet disposed on a surface thereof which is held in abutment against the first member.

Since the first member and the second member of the retainer ring are thus secured to each other under magnetic forces, the first member and the second member remain to stick together even when the retainer ring is vibrated during the polishing process. The retainer ring is prevented from being abruptly lifted off the polishing surface due to vibration. Therefore, the surface pressure imposed by the retainer ring is stabilized, reducing the possibility that the semiconductor wafer may slip out of the substrate holding apparatus.

If a need arises to separate the first member and the second member from each other for maintenance or the like, then the coupling between the first member and the second member under magnetic forces is weakened to allow the first member and the second member to be separated easily from each other.

The first member may comprise a piston for pressing the second member against the polishing surface, or the second member may comprise a piston for pressing the first member against the polishing surface. The first member may have a cam mechanism including a cam lifter angularly movable for separating the second member from the first member, or the second member may have a cam mechanism including a cam lifter angularly movable for separating the first member from the second member.

According to a second aspect of the present invention, a polishing apparatus is provided for stably polishing a substrate as a workpiece to be polished while preventing the substrate from slipping out. The polishing apparatus comprises a polishing surface, a top ring body for holding and pressing a substrate against the polishing surface to polish the substrate, and a retainer ring for pressing the polishing surface, the retainer ring being disposed on an outer circumferential portion of the top ring body. The polishing apparatus also has sensors for detecting heights of the retainer ring in at least two positions, and a processor for calculating the gradient of the retainer ring based on the heights of the retainer ring detected by the sensors. The sensors should preferably be disposed respectively upstream and downstream of the top ring body in a rotating direction of the polishing surface.

The heights of the retainer ring in at least two positions are detected by the sensors, and the gradient of the retainer ring is calculated from the detected heights by the processor. By thus calculating the gradient of the retainer ring, the processor can predict the possibility that the substrate held by the top ring body may slip out of the top ring body due to excessive inclination of the retainer ring. Therefore, the substrate can be prevented from slipping out of the top ring body based on the predicted possibility.

According to a third aspect of the present invention, a polishing method is provided for stably polishing a substrate as a workpiece to be polished while preventing the substrate from slipping out. The polishing method polishes the substrate by holding an outer circumferential portion of the substrate with a retainer ring disposed on an outer circumferential portion of a top ring body, and pressing the substrate against a polishing surface with the top ring body while pressing the retainer ring against the polishing surface. The polishing method comprises measuring the gradient of the retainer ring, and generating an external alarm signal, stopping polishing the substrate, or changing to a preset polishing condition if the gradient of the retainer ring exceeds a predetermined threshold.

The present invention also provides another polishing method. The polishing method polishes a substrate by holding an outer circumferential portion of the substrate with a retainer ring disposed on an outer circumferential portion of a top ring body, and pressing the substrate against a polishing surface with said top ring body while pressing a retainer ring body against said polishing surface. The polishing method comprises measuring the gradient of the retainer ring body and generating an external alarm signal, stopping polishing the substrate, or changing to a preset polishing condition when the gradient of the retainer ring body exceeds a predetermined threshold.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
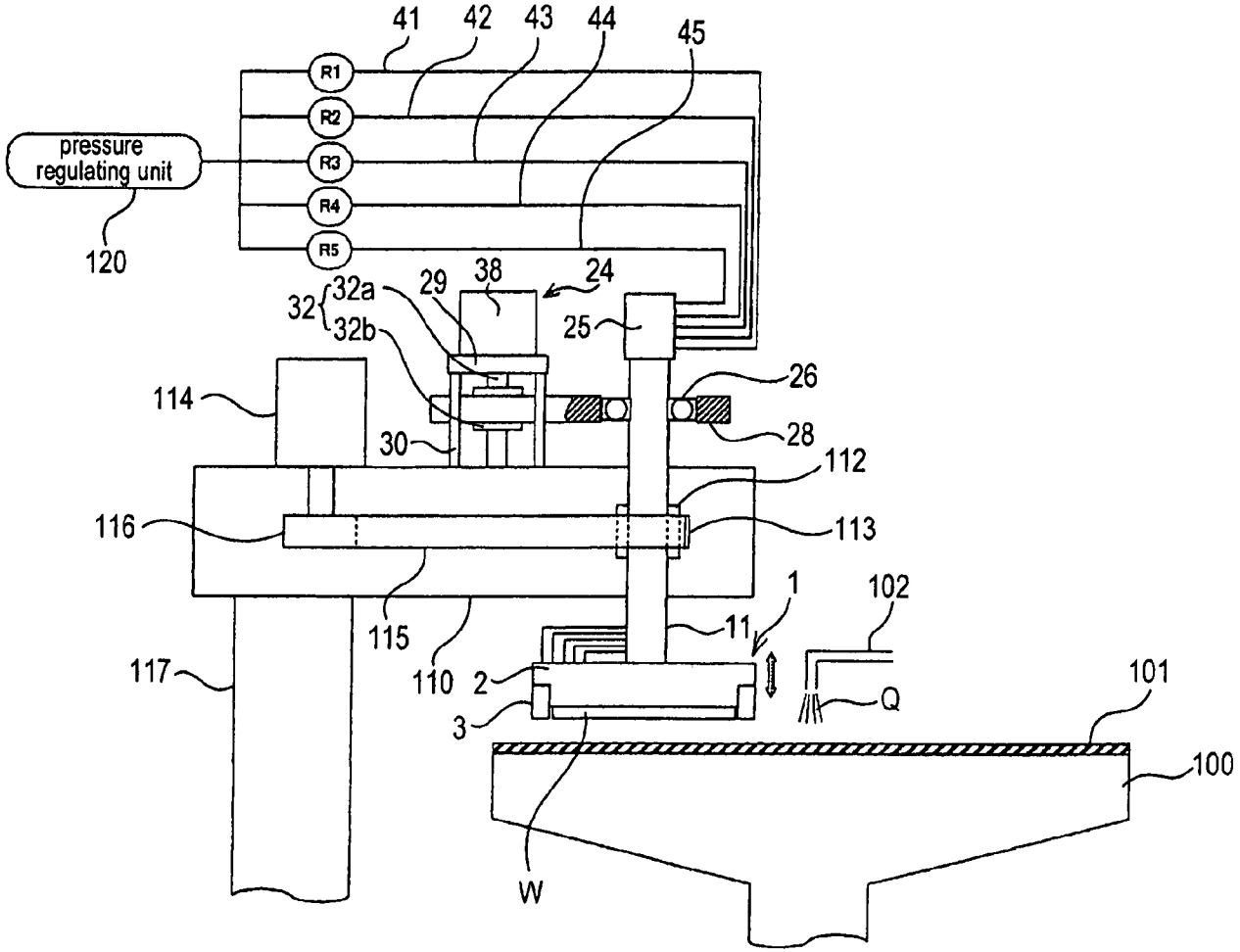
FIG. 1 is a schematic side view of a polishing apparatus incorporating a top ring (substrate holding apparatus) according to a first embodiment of the present invention.

Embodiments of a substrate holding apparatus and a polishing apparatus according to the present invention will be described in detail below with reference to the drawings. FIG. 1 shows in schematic side view of a polishing apparatus incorporating a substrate holding apparatus according to a first embodiment of the present invention. The substrate holding apparatus serves to hold a substrate, such as a semiconductor wafer or the like, as a workpiece to be polished and press the substrate against a polishing surface on a polishing table. As shown in FIG. 1, the polishing apparatus includes a top ring 1, which constitutes a substrate holding apparatus according to the present invention, and a polishing table 100 disposed below the top ring 1, with a polishing pad 101 attached to an upper surface of the polishing table 100. A polishing liquid supply nozzle 102 is disposed above the polishing table 100. The polishing liquid supply nozzle 102 supplies a polishing liquid Q onto the polishing pad 101 on the polishing table 100.

Various kinds of polishing pads are available on the market. For example, some of these are SUBA800, IC-1000, and IC-1000/SUBA400 (two-layer cloth) manufactured by Rodel Inc., and Surfin xxx-5 and Surfin 000 manufactured by Fujimi Inc. SUBA800, Surfin xxx-5, and Surfin 000 are non-woven fabrics bonded by urethane resin, and IC-1000 is made of rigid foam polyurethane (single-layer). Foam polyurethane is porous and has a large number of fine recesses or holes formed in its surface.

The top ring 1 is connected to a lower end of a top ring shaft 11, which is vertically movable with respect to a top ring head 110 by a vertically moving mechanism 24. When the vertically moving mechanism 24 vertically moves the top ring shaft 11, the top ring 1 is lifted and lowered as a whole for positioning with respect to the top ring head 110. A rotary joint 25 is mounted on the upper end of the top ring shaft 11.

The vertically moving mechanism 24 for vertically moving the top ring shaft 11 and the top ring 1 comprises a bridge 28 on which the top ring shaft 11 is rotatably supported by a bearing 26, a ball screw 32 mounted on the bridge 28, a support base 29 supported by support posts 30, and an AC servomotor 38 mounted on the support base 29. The support base 29, which supports the AC servomotor 38 thereon, is fixedly mounted on the top ring head 110 by the support posts 30.

The ball screw 32 comprises a screw shaft 32*a* coupled to the AC servomotor 38 and a nut 32*b* threaded over the screw shaft 32*a*. The top ring shaft 11 is vertically movable in unison with the bridge 28 by the vertically moving mechanism 24. When the AC servomotor 38 is energized, the bridge 28 moves vertically via the ball screw 32, and therefore the top ring shaft 11 and the top ring 1 moves vertically.

The top ring shaft 11 is connected to a rotary sleeve 112 by a key (not shown). The rotary sleeve 112 has a timing pulley 113 fixedly disposed therearound. A top ring motor 114 having a drive shaft is fixed to an upper surface of the top ring head 110. The timing pulley 113 is operatively coupled to a timing pulley 116, mounted on the drive shaft of the top ring motor 114, by a timing belt 115. When the top ring motor 114 is energized, the timing pulley 116, the timing belt 115, and the timing pulley 113 are rotated to rotate the rotary sleeve 112 and the top ring shaft 11 in unison with each other, thus rotating the top ring 1. The top ring head 110 is supported on a top ring head shaft 117 rotatably supported on a frame (not shown).

Figure 2:
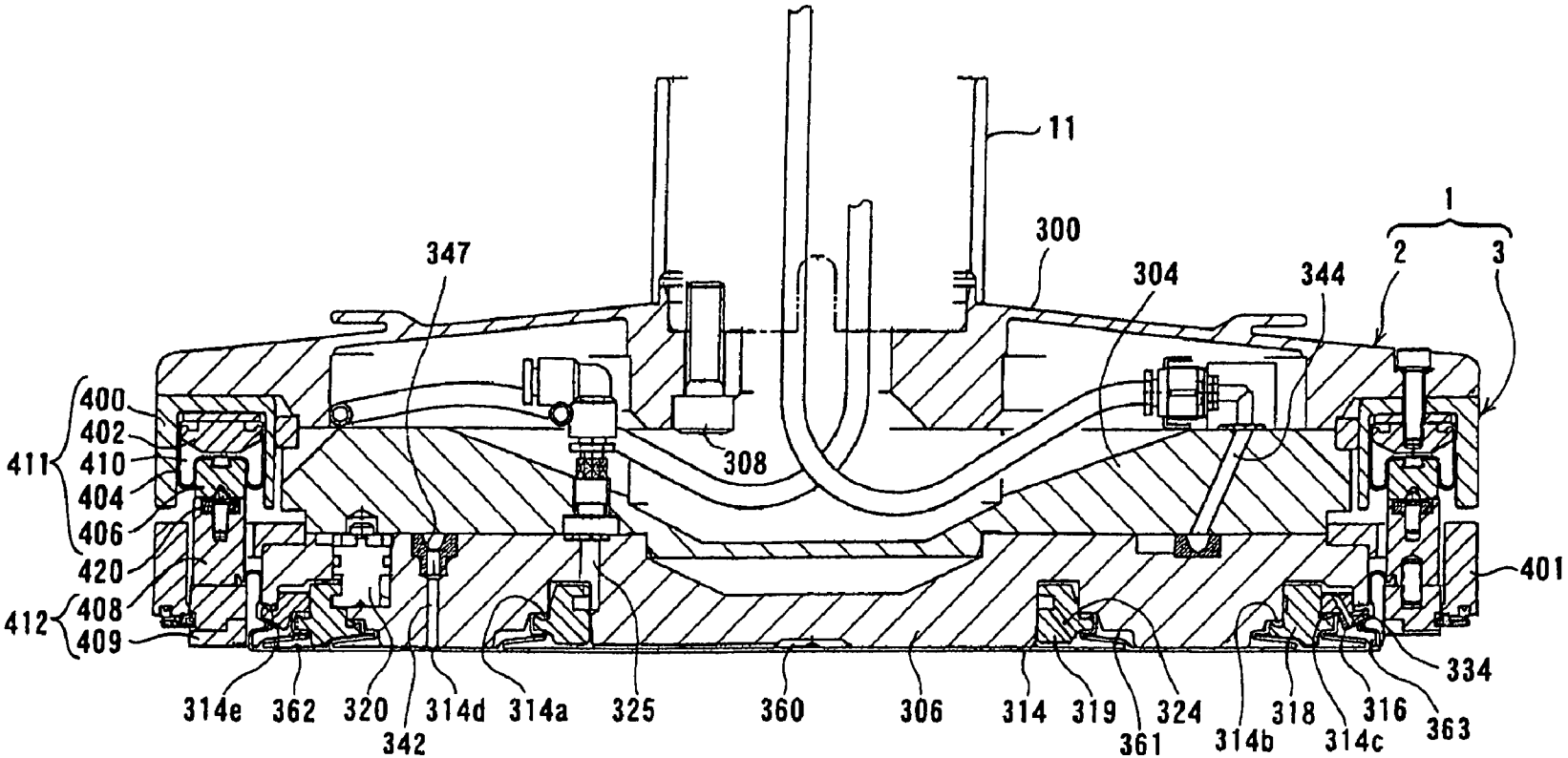
FIG. 2 is a vertical cross-sectional view of the top ring in the polishing apparatus shown in FIG. 1.

FIG. 2 shows the top ring 1 in vertical cross section. As shown in FIG. 2, the top ring 1 basically comprises a top ring body 2 for pressing a semiconductor wafer held on its lower surface against a polishing pad 101 as a polishing surface, and a retainer ring 3 for directly pressing the polishing pad 101. The top ring body 2 has a disk-shaped upper member 300, an intermediate member 304 mounted on a lower surface of the upper member 300, and a lower member 306 mounted on a lower surface of the intermediate member 304. The retainer ring 3 has a cylinder 400 mounted on the lower surface of an outer circumferential portion of the upper member 300 and a guide 401 mounted on an outer circumferential portion of the lower member 306. The cylinder 400 and the guide 401 are thus rotatable in unison with the top ring body 2.

The upper member 300 is fastened to the top ring shaft 11 by bolts 308. The intermediate member 304 is fastened to the upper member 300 by bolts (not shown). The lower member 306 is fastened to the intermediate member 300 by bolts (not shown). The upper member 300, the intermediate member 304, and the lower member 306 jointly make up a main assembly which is made of synthetic resin, such as engineering plastics (e.g., PEEK).

An elastic membrane 314 for abutting engagement with the reverse side of a semiconductor wafer is mounted on the lower surface of the lower member 306. The elastic membrane 314 is attached to the lower surface of the lower member 306 by an annular edge holder 316 disposed on an outer circumferential edge portion of the lower member 306, and an annular auxiliary ring 318 and a holder 319 which are disposed radially inwardly of the annular edge holder 316. The elastic membrane 314 is made of a highly strong and durable rubber material, such as ethylene propylene rubber (EPDM), polyurethane rubber, or silicone rubber.

The edge holder 316 is held by the auxiliary ring 318 that is attached to the lower surface of the lower member 306 by a plurality of stoppers 320. The holder 319 is attached to the lower surface of the lower member 306 by a plurality of stoppers (not shown). These stoppers are positioned at equally spaced intervals in the circumferential direction of the top ring 1.

As shown in FIG. 2, the elastic membrane 314 has a central chamber 360 defined centrally therein. The holder 319 has a fluid passage 324 defined therein which communicates with the central chamber 360. The lower member 306 has a fluid passage 325 defined therein which communicates with the fluid passage 324. The fluid passages 324, 325 are connected to a pressure regulating unit 120 through a fluid passage 41 and a regulator R1 both shown in FIG. 1. The pressure regulating unit 120 supplies a fluid under pressure through the regulator R1, the fluid passages 41, 325, 324 to the central chamber 360. The pressure regulating unit 120 regulates the pressure of the fluid by supplying a pressurized fluid, such as pressurized air, from a compression air source or evacuating the fluid passages with a pump or the like.

The holder 319 holds a ripple partition 314*a* of the elastic membrane 314 against the lower surface of the lower member 306. The auxiliary ring 318 holds an outer partition 314*b* and an edge partition 314*c* of the elastic membrane 314 against the lower surface of the lower member 306.

As shown in FIG. 2, an annular ripple chamber 361 is defined between the ripple partition 314*a* and the outer partition 314*b* of the elastic membrane 314. A gap 314*d* is defined in the elastic membrane 314 between the auxiliary ring 318 and the holder 318. The lower member 306 has a fluid passage 342 defined therein that communicates with the gap 314*d*. The intermediate member 304 has a fluid passage 344 defined therein that communicates with a fluid passage 342 defined in the lower member 306. An annular groove 347 is defined in the lower member 306 at the junction between the fluid passage 342 in the lower member 306 and the fluid passage 344 in the intermediate member 304. The fluid passage 342 in the lower member 306 is connected to the pressure regulating unit 120 through the annular groove 347, the fluid passage 344 in the intermediate member 304, and a fluid passage 42 and a regulator R2 both shown in FIG. 1. The pressure regulating unit 120 supplies a fluid under pressure through the regulator R2 and the fluid passages 42, 344, 342 to the ripple chamber 361. The fluid passage 342 is selectively connected to a vacuum pump (not shown). When the vacuum pump is actuated, a semiconductor wafer can be attracted to the lower surface of the elastic membrane 314.

As shown in FIG. 2, the auxiliary ring 318 has a fluid passage (not shown) defined therein that communicates with an annular outer chamber 362 which is defined between the outer partition 314*b* and the edge partition 314*c* of the elastic membrane 314. The lower member 306 has a fluid passage (not shown) defined therein that communicates with the fluid passage in the auxiliary ring 318 through a connector (not shown). The intermediate member 304 has a fluid passage (not shown) defined therein that communicates with the fluid passage in the lower member 306. The fluid passage in the auxiliary ring 318 is connected to the pressure regulating unit 120 through the fluid passage in the lower member 306, the fluid passage in the intermediate member 304, and a fluid passage 43 and a regulator R3 both shown in 1. The pressure regulating unit 120 supplies a fluid under pressure through the regulator R3 and the fluid passage 43, and the fluid passages referred to above to the outer chamber 362.

As shown in FIG. 2, the edge holder 316 holds a sidewall 314*e* of the elastic membrane 314 against the lower surface of the lower member 306. The edge holder 316 has a fluid passage 334 defined therein that communicates with an annular edge chamber 363 defined between the edge partition 314*c* and the sidewall 314*e* of the elastic membrane 314. The lower member 306 has a fluid passage (not shown) defined therein that communicates with the fluid passage 334 in the edge holder 316. The intermediate member 304 has a fluid passage (not shown) defined therein that communicates with the fluid passage in the lower member 306. The fluid passage 334 in the edge holder 316 is connected to the pressure regulating unit 120 through the fluid passage in the lower member 306, the fluid passage in the intermediate member 304, and a fluid passage 44 and a regulator R4 both shown in FIG. 1. The pressure regulating unit 120 supplies a fluid under pressure through the regulator R4 and the fluid passage 44, 334, and the fluid passages referred to above to the edge chamber 363.

In the top ring 1 of this embodiment, the pressures of the fluids supplied to the pressure chambers defined between the elastic membrane 314 and the lower member 306, i.e., the pressures of fluids in the central chamber 360, the ripple chamber 361, the outer chamber 362, and the edge chamber 363, and the pressure of the fluid supplied to a retainer chamber 410 are independently regulated. The top ring 1 with the independently regulated fluid pressures in the various chambers makes it possible to adjust the pressing forces with which the top ring 1 presses the semiconductor wafer against the polishing pad 101, for respective regions of the semiconductor wafer, and also to adjust the pressing force with which the retainer ring 3 presses the polishing pad 101.

The retainer ring 3 serves to hold the outer circumferential edge of the semiconductor wafer. The retainer ring 3 comprises a retainer ring pressing mechanism 411, which includes a hollow cylinder 400 with its upper end closed, a guide 401 with a vertical through hole defined therein, and a vertically movable retainer ring portion 412. An elastic membrane 404 is held in the cylinder 400 by a holder 402 disposed in an upper portion of the cylinder 400, and a piston 406 is connected to the lower end of the elastic membrane 404. The guide 401 holds therein a vertically movable retainer ring portion 412, which can be pressed downwardly by the piston 406, including a ring member 408 and a retainer ring body 409. The elastic membrane 404 is made of a highly strong and durable rubber material, such as ethylene propylene rubber (EPDM), polyurethane rubber, or silicone rubber.

The guide 401 has a plurality of drive pins (not shown) projecting radially inwardly and having respective distal ends extending into the ring member 408. The guide 401 and the retainer ring portion 412 are thus joined to each other by the drive pins for rotation in unison with each other. Specifically, the ring member 408 has a plurality of vertically elongate holes defined therein which receive the respective drive pins of the guide 401. The drive pins of the guide 401 can move vertically in the respective elongate holes, and hence the guide 401 can move vertically relatively to the ring member 408.

The holder 402 has a fluid passage (not shown) defined therein that communicates with a retainer pressure chamber 410 defined by the elastic membrane 404. The cylinder 400 has a fluid passage (not shown) defined in an upper portion thereof that communicates with the fluid passage in the holder 402. The upper member 300 has a fluid passage (not shown) that communicates with the fluid passage in the cylinder 400. The fluid passage in the holder 402 is connected to the pressure regulating unit 120 through the fluid passage in the cylinder 400, the fluid passage in the upper member 300, and a fluid passage 45 and a regulator R5 both shown in FIG. 1. The pressure regulating unit 120 supplies a fluid under pressure through the regulator R5 and the fluid passage 45, and the fluid passages referred to above to the retainer pressure chamber 410. When the pressure of the fluid supplied to the retainer pressure chamber 410 is regulated by the pressure regulating unit 120, the elastic membrane 404 is expanded or contracted to move the piston 406 vertically for thereby pressing the retainer ring body 409 of the retainer ring portion 412 against the polishing pad 101 under a desired pressure. The retainer ring pressing mechanism 411, for pressing the retainer ring portion 412 downwardly, is thus composed of the cylinder 400, the holder 402, the elastic membrane 404, the piston 406, and the retainer pressure chamber 410.

In the illustrated embodiment, the elastic membrane 404 comprises a rolling diaphragm. The rolling diaphragm comprises a diaphragm having a curved region. When the pressure of a fluid in a chamber that is partitioned by a rolling diaphragm changes, the curved region of the diaphragm rolls to increase or reduce the space in the chamber. The rolling diaphragm has a relatively long service life because its expansion is small each time the space in the chamber is increased. As the expansion of the rolling diaphragm is small, a loss of the load on the rolling diaphragm is small, and the load is subject to small variations in the stroke of the rolling diaphragm. Consequently, the force applied to the polishing pad 101 by the retainer ring body 409 of the retainer ring portion 412 can be adjusted to a nicety.

The retainer ring 3 thus constructed allows only the retainer ring portion 412 of the retainer ring 3 to be lowered toward the polishing pad 101. Therefore, even when the retainer ring body 409 of the retainer ring portion 412 is worn, the retainer ring body 409 can be pressed constantly against the polishing pad 101 while the lower member 306 and the polishing pad 101 are being spaced a constant distance from each other. Since the retainer ring portion 412, which includes the retainer ring body 409 held against the polishing pad 101, and the cylinder 400 are connected to each other by the elastic membrane 404 that is elastically deformable, the retainer ring portion 412 is free of a bending moment which would otherwise be produced by an offset of the loaded point. Accordingly, the surface pressure applied by the retainer ring body 409 is uniformized and the retainer ring body 409 has an increased ability to catch up the polishing pad 101. The elastic membrane 404 may be made of a highly strong and durable rubber material, such as ethylene propylene rubber (EPDM), polyurethane rubber, or silicone rubber, which has a hardness ranging from 30 to 80° (JIS-A), or may be made of thin synthetic resin film. Though a thin elastic membrane of low hardness is capable of low-loss load control, it is preferable to determine the hardness and thickness of the elastic membrane 404 in view of the durability thereof.

The piston 406 of the retainer ring pressing mechanism 411 and the ring member 408 of the retainer ring portion 412 are secured to each other under magnetic forces. Specifically, according to this embodiment, the piston 406 is made of a magnetic material and has its surface coated or plated for rust prevention. A magnet 420 is embedded in the surface of the ring member 408 which faces the piston 406. Therefore, the ring member 408 is attracted and secured to the piston 406 under magnetic forces from the magnet 420.

Since the piston 406 and the ring member 408 are thus secured to each other under magnetic forces, the piston 406 and the ring member 408 remain to stick together even when the retainer ring body 409 of the retainer ring portion 412 is vibrated during the polishing process. The retainer ring portion 412 is prevented from being abruptly lifted off the polishing pad 101 due to vibration. Therefore, the surface pressure imposed by the retainer ring body 409 is stabilized, reducing the possibility that the semiconductor wafer may slip out of the top ring 1 (see FIG. 1).

The lower member 306 and the retainer ring portion 412 and other components combined therewith jointly make up a carrier assembly. The carrier assembly is frequently removed from the other parts of the top ring 1 for maintenance. However, the piston 406 is subject to less maintenance. Because the piston 406 of the retainer ring pressing mechanism 411 and the ring member 408 of the retainer ring portion 412 are attached to each other under magnetic forces, the ring member 408 of the carrier assembly, which is removed more frequently, can easily be separated from the piston 406 which is remove less frequently.

Figure 3:
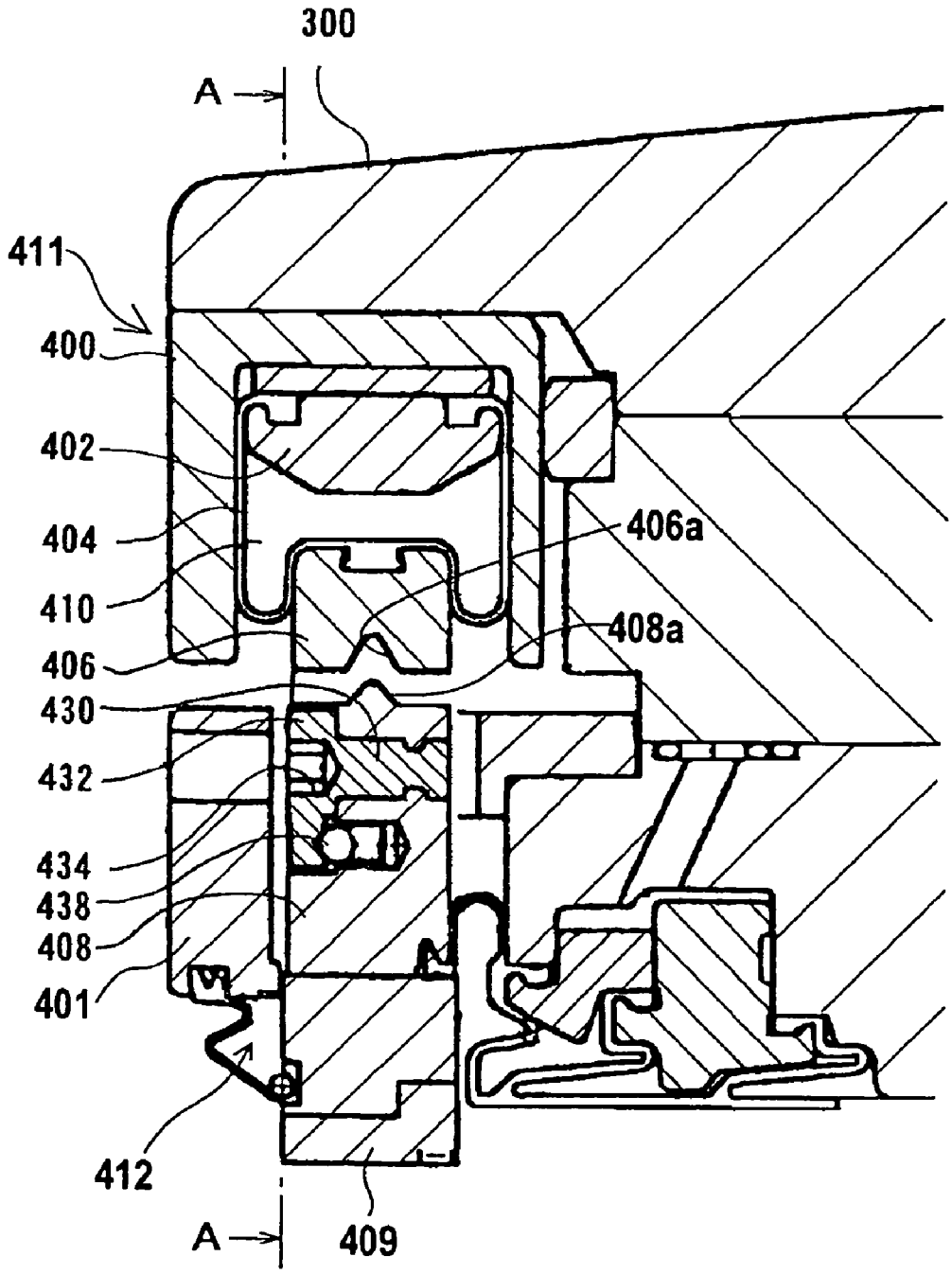
FIG. 3 is an enlarged fragmentary vertical cross-sectional view of a portion of the top ring shown in FIG. 2 near a retainer ring.
Figure 4:
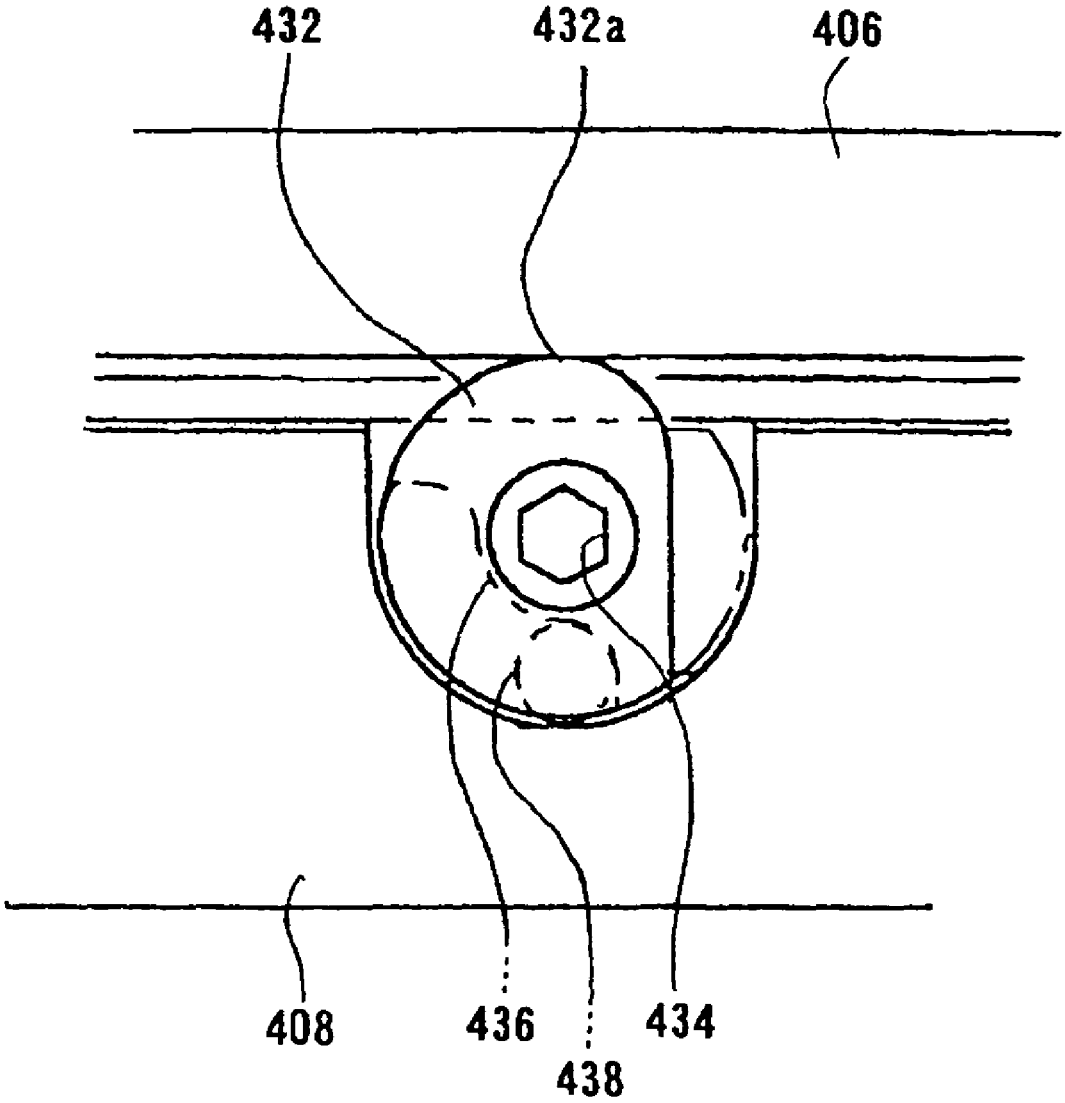
FIG. 4 is a cross-sectional view taken along line IV-IV of FIG. 3.

The top ring 1 has a mechanism for separating the piston 406 of the retainer ring pressing mechanism 411 and the ring member 408 of the retainer ring portion 412 from each other. FIG. 3 shows in enlarged fragmentary vertical cross section a portion of the top ring 1 near the retainer ring 3. As shown in FIG. 3, the ring member 408 has a plurality of cam lifters 432 rotatable about respective shafts 430. FIG. 4 is a cross-sectional view taken along line IV-IV of FIG. 3. As shown in FIG. 4, each of the cam lifters 432 has different radii from the center of the shaft 430. When the cam lifter 432 is turned, a lobe 432*a* thereof, which has the greatest radius, contacts and raises the piston 406. The shaft 430 of each cam lifer 432 has a wrench hole 434 defined coaxially in an outer end surface thereof for the insertion of a wrench therein.

The ring member 408 has an upwardly pointed land 408*a* on an upper surface thereof, and the piston 406 has a recess 406*a* defined in a lower surface thereof, the recess 406*a* being shaped complementarily to the upwardly pointed land 408*a*. When the upwardly pointed land 408*a* of the ring member 408 is fitted in the recess 406*a* of the piston 406, the ring member 408 is positioned with respect to the piston 406.

Each cam lifter 432 has an oblong recess 436 defined in an inner surface thereof, and a ball 438 for being pressed into the recess 436 is disposed on a side surface of the ring member 408. Since the ball 438 that is received in the oblong recess 436 is limited in its movement within the oblong recess 436, the cam lifter 432 is angularly movable about the shaft 430 within an angular range provided by the oblong recess 436.

For maintenance of the carrier assembly, a wrench is inserted into the wrench hole 434 and turned to rotate the cam lifter 432 to cause the lobe 432*a* to raise the piston 406, forcibly creating a gap between the piston 406 of the retainer ring pressing mechanism 411 and the ring member 408 of the retainer ring portion 412. Accordingly, the magnetic forces acting between the piston 406 and the magnet 420 are weakened, allowing the piston 406 and the ring member 408 to be separated easily.

In FIG. 2, the piston 406 is made of a magnetic material, and the magnet 420 is embedded in the ring member 408. However, the ring member 408 may be made of a magnetic material, and the magnet 420 may be embedded in the piston 406. In FIG. 2, the cam lifters 432 are provided on the ring member 408. However, the cam lifters 432 may be provided on the piston 406.

Figure 5:
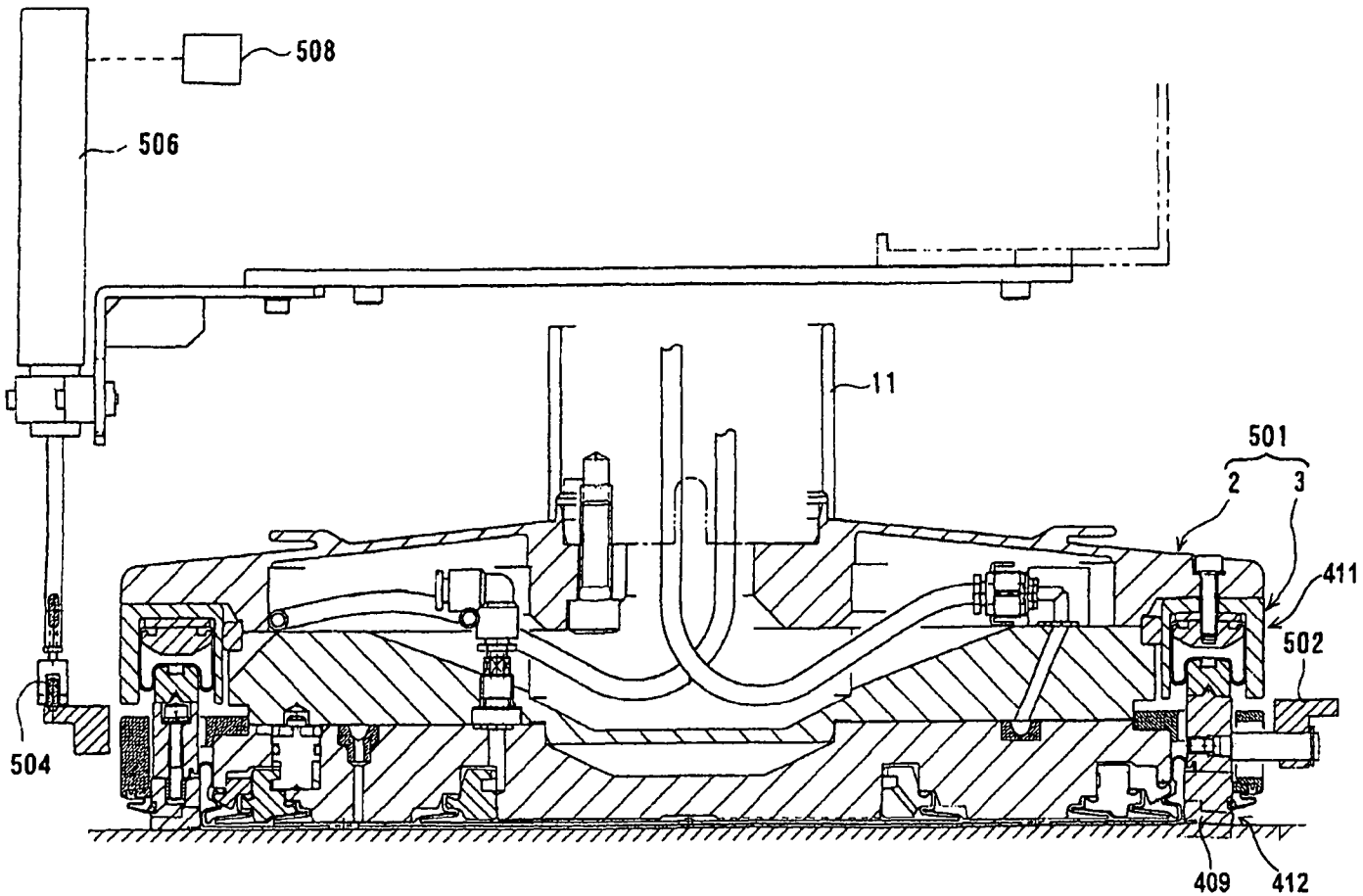
FIG. 5 is a vertical cross-sectional view of a top ring in a polishing apparatus according to a second embodiment of the present invention.
Figure 6:
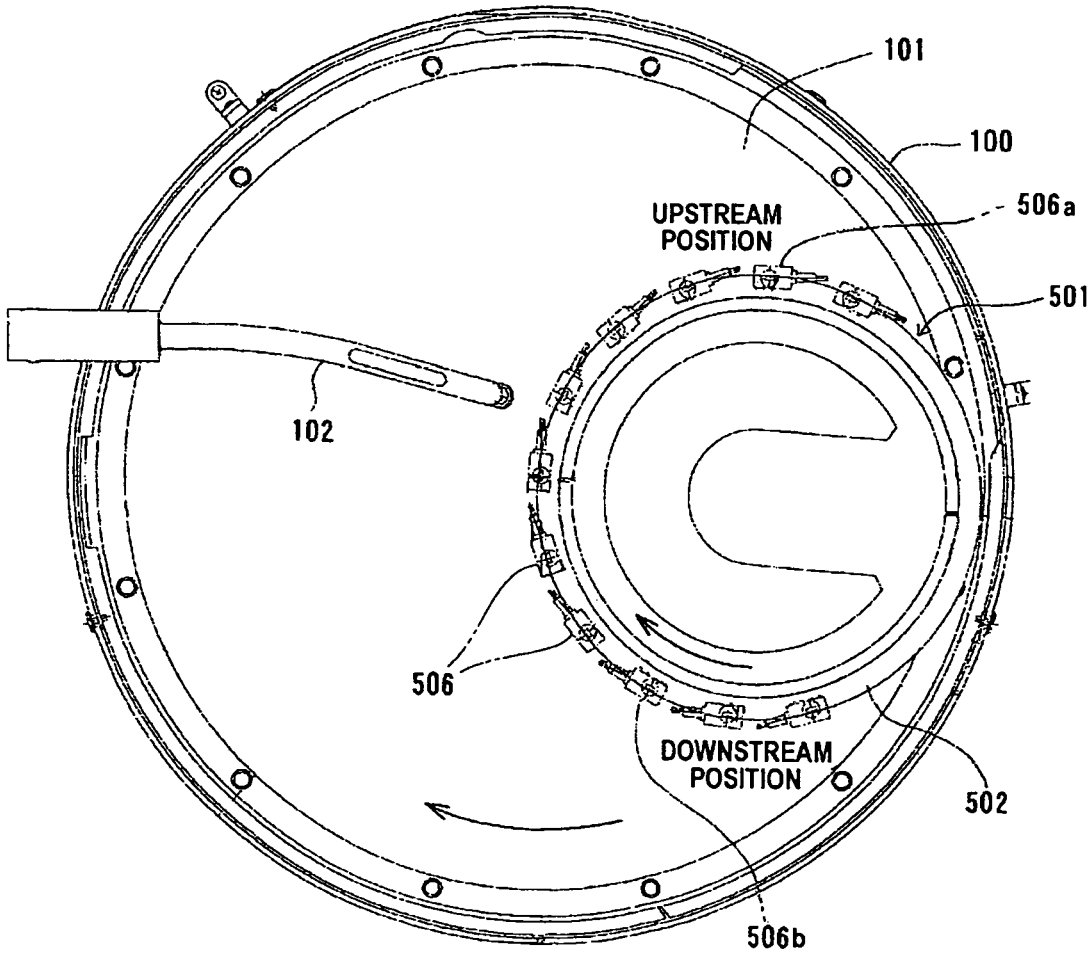
FIG. 6 is a plan view of the polishing apparatus according to the second embodiment of the present invention.

FIG. 5 shows in vertical cross section a substrate holding apparatus (top ring) 501 in a polishing apparatus according to a second embodiment of the present invention. FIG. 6 shows in plan the polishing apparatus. Those parts of the top ring 501 which are identical to those shown in FIGS. 2 and 3 are denoted by identical reference characters, and will not be described in detail below. As shown in FIGS. 5 and 6, the top ring 501 of this embodiment has a ring-shaped measurement plate 502 mounted on an outer circumferential surface of the retainer ring portion 412 of the retainer ring 3. The top ring head, which serves as a mount on which the top ring 501 is mounted, has displacement sensors 506 disposed in two respective positions along the circumferential direction of the top ring 501. Each of the displacement sensors 506 has a roller 504 on its lower end. The displacement sensors 506 are electrically connected to a processor 508 for calculating the gradient of the retainer ring body 409 of the retainer ring portion 412 of the retainer ring 3 based on output signals from the displacement sensors 506.

As shown in FIG. 6, the top ring 501 and the polishing table 100 rotate in the same direction (e.g., clockwise) to polish a semiconductor wafer. During the polishing process, each of the displacement sensors 506 can detect the distance up to the roller 504, or stated otherwise, the height of the retainer ring portion 412 of the retainer ring 3. When the top ring 501 rotates, the roller 504 rolls on the upper surface of the measurement plate 502. Therefore, the displacement sensor 506 can detect the height of the retainer ring portion 412 of the retainer ring 3. The two displacement sensors 506 can detect the height of the retainer ring portion 412 of the retainer ring 3 in at least two positions. Any gradient of the retainer ring body 409 can be calculated from the heights in the two positions of the retainer ring portion 412 which are detected by the displacement sensors 506. The processor 508 calculates the gradient of the retainer ring body 409 based on output signals from the two displacement sensors 506.

The output signals from the respective displacement sensors 506 include signal components representing variations of a thickness of the polishing pad 101, wobbling motions of the polishing table 100, and variations of a thickness of the retainer ring body 409. Therefore, the processor 506 should preferably process the output signals from the respective displacement sensors 506 to determine a moving average thereof.

By thus calculating the gradient of the retainer ring body 409, the processor 508 can predict the possibility that the semiconductor wafer held by the top ring 501 may slip out of the top ring 501 due to excessive inclination of the retainer ring body 409. Therefore, the semiconductor wafer held by the top ring 501 can be prevented from slipping out of the top ring 501 based on the predicted possibility. Specifically, if the calculated gradient of the retainer ring body 409 exceeds a predetermined threshold, then the processor 508 generates an external alarm signal, stops rotating of the top ring 501 and the polishing table 100 to interrupt the polishing process, and/or changes to a preset polishing condition for lowering the load to press the semiconductor wafer against the polishing pad 101, increasing the load applied by the retainer ring body 409, or increasing the rotational speeds of the semiconductor wafer and the polishing pad 101. According to this embodiment, the gradient of the retainer ring body 409 is determined from the height of the retainer ring portion 412 detected in at least two positions, rather than in a single position, and the possibility of a slip-out is predicted or detected based on the determined gradient of the retainer ring body 409. Therefore, the possibility of a slip-out of the semiconductor wafer can accurately be predicted or detected even if the polishing pad 101 is worn.

In FIG. 6, a number of displacement sensors 506 are shown as being located in the circumferential direction of the top ring 501, as indicated by the dotted lines. However, the polishing apparatus may have at least two displacement sensor 506 as described above. Specifically, a first displacement sensor 506*a* should preferably be located upstream of the top ring 501 with respect to the rotating direction of the polishing table 100, and a second displacement sensor 506*b* should preferably be located downstream of the top ring 501 with respect to the rotating direction of the polishing table 100, the first and second displacement sensors 506*a*, 506*b* being disposed diametrically opposite to each other across the top ring 501. The displacement sensors 506 should preferably be disposed on a single circumferential line over the top ring 501, i.e., at the same radius. However, if the positions of the displacement sensors 506 are recognized and the output signals from the displacement sensors 506 are processed accordingly by the processor 508, then the displacement sensors 506 may not necessarily be disposed on the same circumferential line over the top ring 501. In FIG. 6, the gradient of the retainer ring body 409 is measured with respect to the mount on which the top ring 1 is mounted. However, the displacement sensors 506 may be mounted on the polishing table 100, and the gradient of the retainer ring body 409 may be measured with respect to the polishing table 100. If the top ring 501 is of the type wherein the top ring body 2 and the retainer ring 3 are integrally combined with each other, then the height of the top ring 501 may be measured in two positions or more on the upper surface thereof, and the gradient of the top ring 501 as a whole may be determined based on the measured heights to predict or detect the possibility of a slip-out of the semiconductor wafer.

The polishing apparatus incorporating the substrate holding apparatus according to the present invention is capable of stably polishing a substrate while the substrate is being held by the substrate holding apparatus without the possibility of slipping out.

Although certain preferred embodiments of the present invention have been shown and described in detail, it should be understood that various changes and modifications may be made therein without departing from the scope of the present invention.

The invention claimed is:

1. A polishing apparatus comprising:

a polishing surface;

a top ring body for holding and pressing a substrate against said polishing surface to polish the substrate;

a retainer ring for pressing said polishing surface directly and holding an outer circumferential edge of the substrate, said retainer ring having a retainer ring portion which is movable relative to said top ring body;

at least two sensors for detecting respective heights of said retainer ring portion relative to said polishing surface or to said top ring body, said at least two sensors being located in different positions; and a processor for calculating a gradient of said retainer ring portion relative to said polishing surface or to said top ring body based on the respective heights of said retainer ring portion detected by said at least two sensors.

2. A polishing apparatus according to claim 1, wherein one of said at least two sensors is disposed upstream of said top ring body in a rotating direction of said polishing surface, and another of said at least two sensors is disposed downstream of said top ring body in the rotating direction of said polishing surface.

3. A polishing apparatus according to claim 1, wherein said at least two sensors comprise displacement sensors, respectively, and said processor is operable to perform a moving average process on output signals from said at least two displacement sensors.

* * * * *